US009563154B2

(12) United States Patent
Kusano et al.

(10) Patent No.: US 9,563,154 B2
(45) Date of Patent: Feb. 7, 2017

(54) TONER TRANSFER ROLLER AND IMAGE FORMING DEVICE USING THE SAME

(75) Inventors: Satoru Kusano, Yokosuka (JP); Junichiro Sato, Yokohama (JP)

(73) Assignee: BRIDGESTONE CORPORATION, Tokyo (JP)

( * ) Notice: Subject to any disclaimer, the term of this patent is extended or adjusted under 35 U.S.C. 154(b) by 890 days.

(21) Appl. No.: 12/601,934

(22) PCT Filed: May 30, 2008

(86) PCT No.: PCT/JP2008/060075

§ 371 (c)(1),
(2), (4) Date: Jan. 13, 2010

(87) PCT Pub. No.: WO2008/146925

PCT Pub. Date: Dec. 4, 2008

(65) Prior Publication Data

US 2010/0158579 A1 Jun. 24, 2010

(30) Foreign Application Priority Data

May 30, 2007 (JP) ..... 2007-143995

(51) Int. Cl.
*G03G 15/02* (2006.01)
*G03G 15/16* (2006.01)

(52) U.S. Cl.
CPC ..... *G03G 15/1685* (2013.01); *G03G 15/0233* (2013.01); *G03G 2215/025* (2013.01)

(58) Field of Classification Search
CPC ..... G03G 15/0233; G03G 15/0818; G03G 2215/025; G03G 2215/2058–2215/2067; G03G 2215/00683; G03G 15/2057; Y10T 29/49544; Y10T 29/49547; Y10T 29/49549; Y10T 29/4956; Y10T 29/49563

(Continued)

(56) References Cited

U.S. PATENT DOCUMENTS 4,618,241 A * 10/1986 Hays ..... G03G 15/065 399/284
4,764,841 A * 8/1988 Brewington et al. ..... 399/284

(Continued)

FOREIGN PATENT DOCUMENTS

JP 11-038749 A 2/1999
JP 11-84857 A 3/1999

OTHER PUBLICATIONS

Office Action issued May 25, 2011, in Chinese Patent Application No. 200880018186.6 with English translation.

*Primary Examiner* — Christopher Besler
(74) *Attorney, Agent, or Firm* — Sughrue Mion, PLLC

(57) ABSTRACT

The present invention provides a toner transfer roller which exhibits decreased toner charge (Q/M) and an enhanced toner transfer rate (M/A). Specifically, the present invention provides: a toner transfer roller for a negatively chargeable toner, comprising a rotating shaft and a polyurethane foam body layer provided to surround the rotating shaft, wherein the polyurethane foam body layer contains a charge control agent which is negatively chargeable with respect to polyurethane in triboelectric series; and a toner transfer roller for a positively chargeable toner, comprising said rotating shaft and said polyurethane foam body layer, wherein said polyurethane foam body layer contains a charge control agent which is positively chargeable with respect to polyurethane in triboelectric series.

19 Claims, 2 Drawing Sheets

(58) Field of Classification Search
USPC ..... 492/17, 18, 49, 53, 54
See application file for complete search history.

(56) References Cited

U.S. PATENT DOCUMENTS

| | | | | |
|---|---|---|---|---|
| 5,172,169 | A * | 12/1992 | Takashima et al. | 399/281 |
| 5,434,653 | A * | 7/1995 | Takizawa et al. | 399/284 |
| 5,903,808 | A * | 5/1999 | Takizawa et al. | 399/286 |
| 6,326,113 | B1 * | 12/2001 | Okuda et al. | 430/108.21 |
| 6,397,032 | B1 * | 5/2002 | Sakaizawa et al. | 399/286 |
| 2002/0001487 | A1 * | 1/2002 | Tano | 399/286 |
| 2004/0229142 | A1 * | 11/2004 | Dojo et al. | 430/106.1 |
| 2006/0130330 | A1 * | 6/2006 | Kim | 29/895.21 |
| 2006/0183615 | A1 * | 8/2006 | Eun et al. | 492/56 |
| 2011/0212395 | A1 * | 9/2011 | Aoki et al. | 430/108.1 |

* cited by examiner

TONER TRANSFER ROLLER AND IMAGE FORMING DEVICE USING THE SAME

TECHNICAL FIELD

The present invention relates to a toner transfer roller and an image forming device using the toner transfer roller. More specifically, the present invention relates to a toner transfer roller mounted, for example, in a developing device for use in an image forming device such as an electrophotographic device and an electrostatic recording device like a photocopier, a laser printer and a facsimile and capable of controlling a transfer amount of toner in an optimal manner, and an image forming device having the toner transfer roller mounted thereon.

PRIOR ART

In a developing device for use in an image forming device such as an electrophotographic device and an electrostatic recording device like a photocopier, a laser printer and a facsimile, a toner supply roller is provided for supplying toner to a toner carrying body such as a developing roller which attaches toner to an electrostatic latent image carrying body such as a photosensitive drum for development. The toner supply roller of this type is used in a state where the toner supply roller abuts the toner carrying body and functions to transfer toner from a toner supplying part to the toner carrying body and scrape toner off from the toner carrying body. Such a roller as this having a function to transfer toner is called a toner transfer roller.

FIG. 1 is a schematic view showing an example of an image forming device according to an electrophotographic system. Specifically, FIG. 1 shows a structure where a developing roller 2 is provided between a toner supply roller 3 and an image forming body (an electrostatic latent image carrying body) 1 retaining an electrostatic latent image in a state where the outer peripheral surface of the developing roller 2 is in close contact with a surface of the image forming body 1 and a transfer roller 5 abuts the image forming body 1 by way of a recording medium 8 such as paper. Toner is supplied onto the surface of the developing roller 2 by the toner supply roller 3 by rotation of the toner supply roller 3, the developing roller 2 and the image forming body 1 in the direction indicated by an arrow in FIG. 1. The toner is adjusted in shape to an evenly thin film by a doctor blade 4 and attached to the latent image on the image forming body 1, whereby the latent image is visualized. The toner image on the image forming body 1 is transferred to the recording medium 8 by generating an electric field between the image forming body 1 and the transfer roller 5. In FIG. 1, the reference number 6 represents a cleaning roller, by which toner remaining on the surface of the image forming body 1 after the transfer of latent image is removed. The reference number 7 represents a charge roller.

A toner transfer roller like the toner supply roller described above is required to have a function to supply a developing roller with toner, a function to charge the toner and a function to scrape the residue toner off from the developing roller. To satisfy these functions, various measures have been taken. Examples of such measures include a method of reducing inconveniences such as scratchiness in an image by lowering electrical resistivity and the degree of toner charge (Q/M) to increase a rate of toner transfer (M/A) by a method of impregnating a polyurethane foam body constituting a toner transfer roller with an electrically conductive processing solution containing conductive carbon or a method of blending conductive carbon into the polyurethane foam body.

However, the method of impregnating a polyurethane foam body with a processing solution containing conductive carbon has a problem that conductive carbon may come off as a result of repeated compression, friction and the like, thereby lowering electrical conductivity, because carbon simply attaches to the resin skeletons constituting cells of the polyurethane foam body according to the method. Further, in a case where a densely foamed structure is required of the polyurethane foam body, it is difficult to thoroughly impregnate the core of the foam body with the conductive processing solution and thus it is not easy to obtain a densely foamed, stable conductive polyurethane foam body. Yet further, according to this method, an impregnation process using a conductive processing solution containing conductive carbon or the like is necessitated after production of the polyurethane foam body, whereby a significant increase in the production cost is inevitable.

On the other hand, in the method of blending carbon into the polyurethane foam body, dispersion of carbon in the molding process of the polyurethane foam body is necessary. In this case, there is a possibility that the viscosity of the blending solution increases, thus disturbing smooth foaming. Accordingly, the added amount of carbon has to be restricted to a small content, which may not necessarily ensure sufficient conductivity. Further, according to this method, there is a problem that molding by a die, which necessitates a small lot production by a batch system, is necessary and thus the productivity deteriorates.

As an alternative to the aforementioned methods, there has been proposed a method of providing a surface of a toner transfer roller with convex and concave configurations without using an electrically conductive material such as carbon, to physically increase a toner transfer rate (M/A) and reduce inconveniences such as scratchiness in an image (see JP 11-038749).

However, molding by using a die having convex and concave portions in a cavity portion thereof is required in order to provide a surface of a toner transfer roller with convex and concave configurations, whereby in this case there is a problem that the production costs of the toner transfer roller significantly increase, which costs include a cost for producing a mold, a cost for maintenance of the mold, and a cost for ensuring good releasing property from the mold (i.e. a cost for applying a mold-releasing agent or fluorine-coating to the mold).

DISCLOSURE OF THE INVENTION

Problems to be Solved by the Invention

An object of the present invention is to provide a toner transfer roller capable of decreasing toner charge (Q/M) and increasing a toner transfer rate (M/A) in a situation as described above.

Means for Solving the Problems

The inventors of the present invention, as a result of a keen study for achieving the aforementioned object, have discovered that the problems described above can be solved by selecting, in accordance with charging property of toner, a charge control agent chargeable to have the same charge as toner with respect to a polyurethane foam body constituting a toner transfer roller in triboelectric series and blending the charge control agent into the polyurethane foam body. The present invention has been completed on the basis of the discovery.

Specifically, the present invention provides:

(1) a toner transfer roller for a negatively chargeable toner, comprising a rotating shaft and a polyurethane foam body layer provided to surround the rotating shaft, wherein the polyurethane foam body layer contains a charge control agent which is negatively chargeable with respect to polyurethane in triboelectric series;

(2) a toner transfer roller for a positively chargeable toner, comprising a rotating shaft and a polyurethane foam body layer provided to surround the rotating shaft, wherein the polyurethane foam body layer contains a charge control agent which is positively chargeable with respect to polyurethane in triboelectric series; and (3) an image forming device, characterized in that it is provided with the toner transfer roller of (1) or (2) above.

Effect of the Invention

According to the present invention, it is possible to inexpensively provide a toner transfer roller which can decrease toner charge (Q/M) and increase a toner transfer rate (M/A).

EXPLANATION OF REFERENCE NUMERALS

Figure 1:
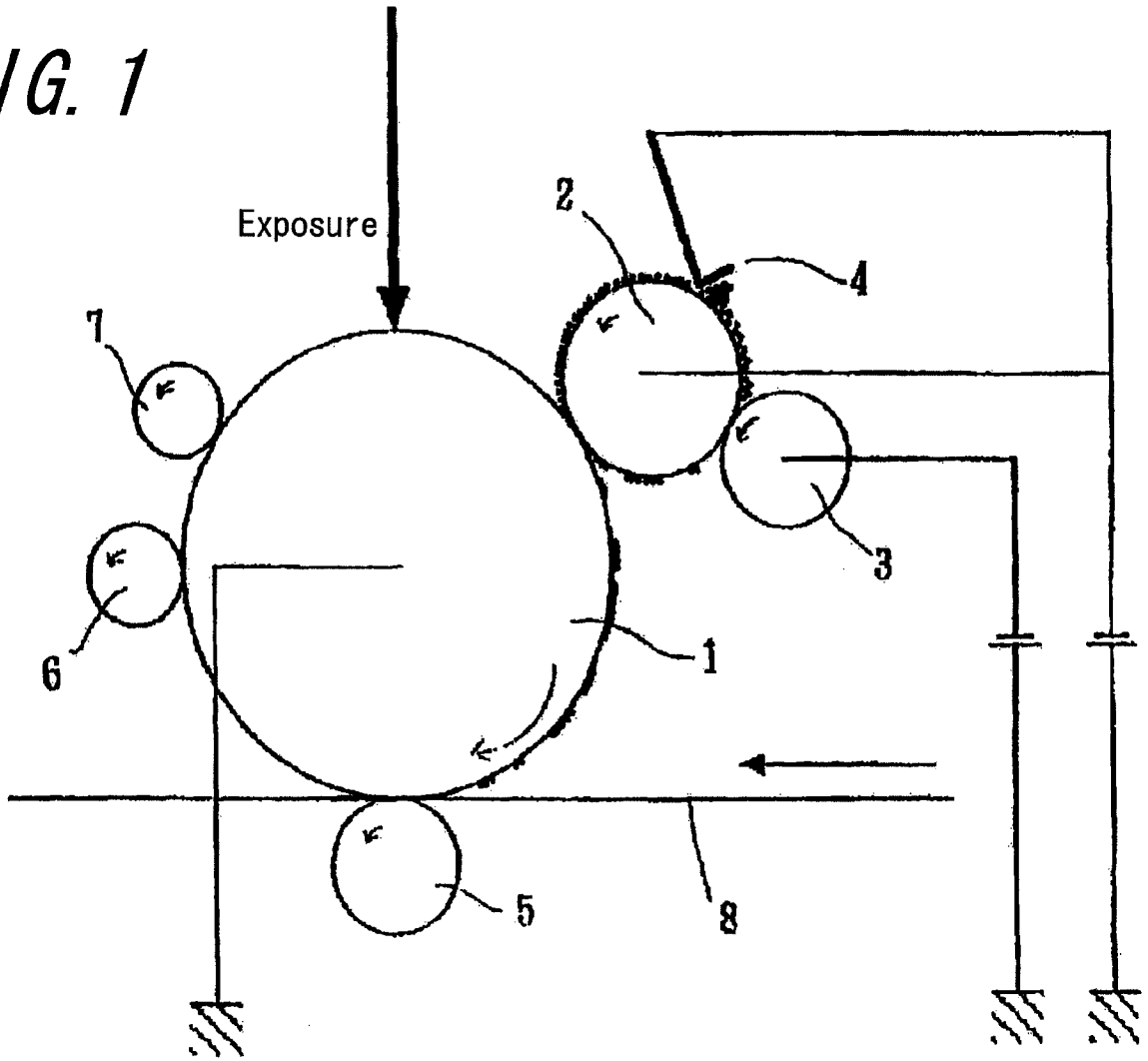
FIG. 1 is a schematic view showing an example of an image forming device according to an electrophotographic system.

1 Image forming body
2 Developing roller
3 Toner supply roller
4 Blade
5 Transfer roller
6 Cleaning roller
7 Charge roller
8 Recording medium

BEST MODE FOR IMPLEMENTING THE INVENTION

A toner transfer roller of the present invention is a roller having a rotating shaft and a polyurethane foam body layer provided to surround the rotating shaft. The present invention is characterized in that it selects, in accordance with charging property of toner, i.e. whether toner is charged positively or negatively, a charge control agent chargeable to have the same charge as toner with respect to a polyurethane foam body constituting a toner transfer roller in triboelectric series and blends the charge control agent into the polyurethane foam body. In the present invention, "a charge control agent" represents a substance which is generally used as a charge or charging control agent for toner.

In a case where the toner transfer roller of the present invention is used for a negatively chargeable toner, the polyurethane foam body is impregnated with a charge control agent which is more negatively chargeable with respect to the polyurethane foam body in triboelectric series (which charge control agent will be referred to as "a negatively chargeable charge control agent" hereinafter). In general, charge magnitude is determined by various environments and conditions. It is known that a charge control agent exhibits a faster rate of reaching a predetermined charge magnitude in triboelectric series than other compounds which are chargeable in the same manner as the agent. Since friction charge is generated at a contact point between toner, the toner transfer roller and the developing roller and the toner transfer roller is charged at the instant when each of the rollers rotates and rubs toner, it is important that the toner transfer roller contains a charge control agent. The toner transfer roller of the present invention is suitably applied to an image forming device, and it is preferable to use the same charge control agent as that is contained in a toner used in the image fondling device or a charge control agent which is negatively chargeable and exhibiting a relatively fast charge rate or a charge control agent which is more negatively chargeable than these two charge control agents in triboelectric series, in terms of achieving an effect of the present invention with a relatively small amount of the charge control agent.

Due to the structure as described above, it is possible to impart the polyurethane foam body layer with negatively charging property, whereby toner can be efficiently supplied to the developing roller because not only toner is physically supplied by bringing the toner transfer roller and the developing roller in rubbing contact with each other but also toner and the toner transfer roller showing negative charge electrically repel each other.

On the other hand, in a case where a positively chargeable toner is used as toner, the polyurethane foam body is impregnated with a charge control agent which is more positively chargeable with respect to the polyurethane foam body in triboelectric series (which charge control agent will be referred to as "a positively chargeable charge control agent" hereinafter). As the positively chargeable charge control agent, a substance known as a charge control agent for toner is generally used as in the negatively chargeable charge control agent. Further, as is the case with the negatively chargeable charge control agent, when the toner transfer roller of the present invention is applied to an image forming device, it is preferable to use the same charge control agent as that is contained in a toner used in the image forming device or a charge control agent which is positively chargeable and exhibiting a relatively fast charge rate or a charge control agent which is more positively chargeable than these two charge control agents in triboelectric series.

Due to the structure as described above, it is possible to impart the polyurethane foam body layer with positively charging property, whereby toner can be efficiently supplied to the developing roller because not only toner is physically supplied by bringing the toner transfer roller and the developing roller in rubbing contact with each other but also toner and the toner transfer roller showing positive charge electrically repel each other.

It can be specifically determined by the following method whether a charge control agent is negatively chargeable or positively chargeable with respect to the polyurethane foam body in triboelectric series (the method of determining a position in triboelectric series).

First, a material to be analyzed is left under an atmosphere at 23° C. and relative humidity of 55% for 4 hours. Static electricity is then removed from the material by using an antistatic blower "SJ-F300" (manufactured by Keyence Corporation). A polyurethane foam body and the material to be analyzed are rubbed against each other and measurement is carried out by using a highly precise static electricity sensor ("SK" manufactured by Keyence Corporation). It is determined how or whether positively or negatively the polyurethane foam body and the material to be analyzed are charged, respectively.

The content of the negatively/positively chargeable charge control agent is preferably in the range of 0.1 to 10 parts by mass with respect to 100 parts by mass of the polyurethane foam body. In a case where the content of the negatively/positively chargeable charge control agent is at least 0.1 parts by mass, the magnitude of toner charge (Q/M) is decreased and a toner transfer rate (M/A) is increased, whereby the effect of the present invention can be achieved in a satisfactory manner. Further, in a case where the content of the negatively/positively chargeable charge control agent is equal to or lower than 10 parts by mass, the foaming property of the polyurethane foam body is not marred. In view of these facts, the content of the negatively/positively chargeable charge control agent is more preferably in the range of 1 to 5 parts by mass with respect to 100 parts by mass of the polyurethane foam body.

Specific examples of the negatively chargeable charge control agent for use in the present invention include: (A) borate ester compound; (B) polyhydroxy alkanoate; (C) a metal compound of salicylic acid derivative; (D) a metal compound of oxynaphthoic acid derivative; (E) azo based metal complex compound; (F) a metal compound of aromatic oxycarboxylic acid; (G) copolymer obtained by polymerization using a monomer having a sulfonate group as a copolymer component; (H) copolymer obtained by polymerization using a monomer having a carboxyl group as a copolymer component; (I) an organic metal compound in which zinc and one of zirconium and aluminum is coordinated by and/or bonded with an aromatic compound selected from the group consisting of aromatic diol, aromatic hydroxycarboxylic acid, aromatic monocarboxylic acid and aromatic polycarboxylic acid; (J) a complex of boron or aluminum and a benzilic acid derivative; (K) a sulfur-containing resin; and the like. Only one type of these negatively chargeable charge control agents may be used solely or two or more types thereof may be used in combination.

As the borate ester compound, a compound as represented by general formula (I) below is suitably used.

(I)

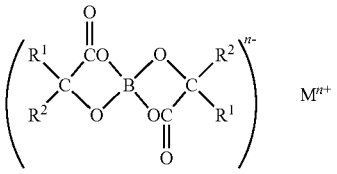

In formula (I) above, $R^1$ and $R^2$ represent hydrogen atoms, alkyl group or aryl group, respectively. $R^1$ and $R^2$ may be of the same atom or group. M represents alkali metal or alkaline earth metal and n represents an integer.

In general formula (I), the types of the alkyl groups represented by $R^1$ and $R^2$ are not particularly restricted. $R^1$ and $R^2$ are preferably C1-C18 alkyl groups, more preferably methyl, ethyl, propyl, butyl and pentyl groups, and further preferably butyl, pentyl groups.

Further, preferable examples of the aryl group include phenyl, tolyl, xylyl, biphenyl, naphthyl, anthryl and phenanthryl groups. A phenyl group is particularly preferable among these examples.

Yet further, preferable examples of alkaline metal or alkaline earth metal represented by M include lithium, potassium, calcium, sodium and the like, and lithium and potassium are particularly preferable.

As polyhydroxy alkanoate (B), a substance as represented by general formula (II) below is suitably used.

(II)

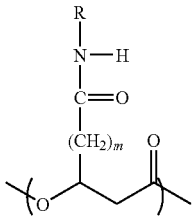

In general formula (II), R represents $-A^1-(SO_2R^3)_X$. $R^3$ represents OH, a halogen atom, ONa, OK, or $OR^{3a}$, $R^{3a}$ and $A^1$ represent a substituted or unsubstituted aliphatic hydrocarbon group, a substituted or unsubstituted aromatic group or a substituted or unsubstituted heterocyclic group, respectively, and m and x represent integers selected from 1 to 8, respectively. In a case where plural units exist in the substance, R, $R^3$, $R^{3a}$, $A^1$, m and x represent the aforementioned components for each of the units independently.

As the metal compound of salicylic acid derivative (C), a metal compound of dialkyl salicylic acid is preferable and a metal compound of di-tert-butylsalicylic acid is particularly preferable. Further, preferable examples of the metal element include aluminum, gallium, magnesium, calcium, titanium, chromium, zinc, zirconium, hafnium and the like. An aluminum compound is particularly preferable.

Examples of the metal compound of oxynaphthoic acid derivative (D) include an organic metal compound constituted of an oxynaphthoic acid derivative represented by general formula (III) below and a metal such as aluminum, chromium, cobalt, iron, titanium, zinc or the like.

(III)

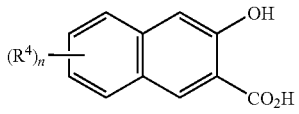

In general formula (III), $R^4$ represents hydrogen or a normal or branched alkyl, alkoxy, nitro, amino, carboxyl, aralkyl, phenyl, benzyl group or a halogen atom, and n represents an integer in the rage of 0 to 4.

As the azo based metal complex compound (E), a substance as represented by general formula (IV) below is suitably used.

(IV)

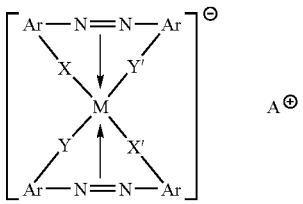

In general formula (IV), M represents a meta coordination center, of which examples include chromium, cobalt, nickel, manganese, iron, titanium, aluminum and the like, Ar represents an aryl group which may have a substituent group of various types, X, X', Y and Y' represent O, CO, NH or $NR^5$ ($R^5$ is a C1-C4 alkylene group), respectively, and $A^+$ represents hydrogen ion, sodium ion, potassium ion, ammonium ion, aliphatic ammonium ion or a mixture thereof.

Examples of aromatic oxycarboxylic acid as a constituent of the metal compound of aromatic oxycarboxylic acid (F) include salicylic acid, m-oxybenzoic acid, p-oxycarboxylic acid, gallic acid, mandelic acid and tropic acid. Among these examples, polyvalent aromatic carboxylic acid is preferable and isophthalic acid, terephthalic acid, trimellitic acid and naphthalene dicarboxylic acid are particularly preferable for use. As the metal species forming a metal compound together with the aromatic carboxylic acid described above, a polyvalent metal is preferable and specific examples thereof include magnesium, calcium, strontium, lead, iron, cobalt, nickel, zinc, copper, zirconium, hafnium, aluminum, chromium and the like.

As the monomer having a sulfonate group in a copolymer (G) obtained by polymerization using the monomer having a sulfonate group as a copolymer component, an acylamide monomer containing sulfonic acid is particularly preferable, and examples thereof include 2-acrylamidepropanesulfonic acid, 2-acrylamide-n-butanesulfonic acid, 2-acrylamide-n-hexanesulfonic acid, 2-acrylamide-n-octanesulfonic acid, 2-acrylamide-n-dodecanesulfonic acid, 2-acrylamide-n-tetradecanesulfonic acid, 2-acrylamide-n-methylpropanesulfonic acid, 2-acrylamide-2-phenylpropanesulfonic acid, 2-acrylamide-2,2,4-trimethylpentanesulfonic acid, 2-acrylamide-2-methylphenylethanesulfonic acid, 2-acrylamide-2-(4-chrolophenyl) propanesulfonic acid, 2-acrylamide-2-carboxymethylpropanesulfonic acid, 2-acrylamide-2-(2-pyridyl)propanesulfonic acid, 2-acrylamide-1-methylpropanesulfonic acid, 3-acrylamide-3-methylbutanesulfonic acid, 2-methacrylamide-n-decanesulfonic acid, and 2-methacrylamide-n-tetradecanesulfonic acid.

Among the examples described above, 2-acrylamide-2-methylpropanesulfonic acid is particularly preferable.

Examples of other copolymerization components include styrene monomer, olefin monomer, diene monomer, and vinyl monomers such as halogenated vinyl, vinyl ester, (meth)acrylic acid.

In the copolymer (H) obtained by polymerization using a monomer having a carboxyl group as a copolymer component, a substance as represented by general formula (V) or general formula (VI) below is suitably used as the monomer having carboxyl group.

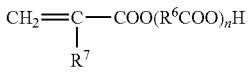

(V)

In general formula (V), $R^6$ represents a C2-C6 alkylene group, $R^7$ represents hydrogen atom or methyl group, and n represents an integer in the range of 0 to 10.

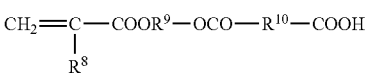

(VI)

In general formula (VI), $R^8$ represents hydrogen atom or methyl group, $R^9$ represents a C2-C4 alkylene group, and $R^{10}$ represents ethylene group, vinylene group, 1,2-cyclohexylene group or 1,2-phenylene group.

Examples of the monomer having carboxyl group as represented by general formula (V) include (meth)acrylic acid, (meth)acrylic acid dimmer, co-carboxy-polycaprolactone mono(meth)acrylate and the like.

Further, examples of the monomer having carboxyl group as represented by general formula (VI) include succinic acid monohydroxyethyl(meth)acrylate, maleic acid monohydroxyethyl(meth)acrylate, fumaric acid monohydroxyethyl (meth)acrylate, phthalic acid monohydroxyethyl(meth)acrylate, 1,2-dicarboxycyclohexane mono-hydroxyethyl(meth) acrylate.

Further, examples of other copolymerization components of the copolymer (H) include, as in the copolymer (G), styrene monomer, olefin monomer, diene monomer, and vinyl monomers such as halogenated vinyl, vinyl ester, (meth)acrylic acid.

The organic metal compound (I) in which zinc and zirconium or aluminum is coordinated by and/or bonded with an aromatic compound selected from the group consisting of aromatic diol, aromatic hydroxycarboxylic acid, aromatic monocarboxylic acid and aromatic polycarboxylic acid represents a substance which is a metal complex or a metal complex salt formed by zinc and zirconium or aluminum and aromatic compounds as ligands of the metal.

As the complex (J) of boron or aluminum and a benzilic acid derivative, a compound as represented by general formula (VII) below is suitably used.

(VII)

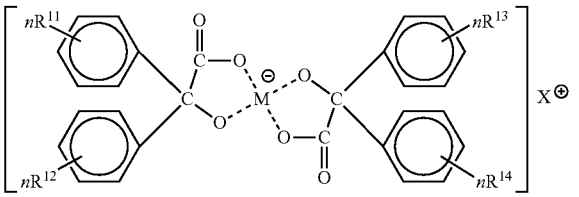

In general formula (VII), M represents boron or aluminum, X represents lithium, sodium or potassium, $R^{11}$, $R^{12}$, $R^{13}$ and $R^{14}$ represent hydrogen atom, a C1-C4 alkyl group, a C1-C4 alkoxy group or a halogen atom, respectively. $R^{11}$, $R^{12}$, $R^{13}$ and $R^{14}$ may each exist in plural form and such plural $R^{11}$s may be constituted of either the same group or different groups, which requirement is applied to plural $R^{12}$s, plural $R^{13}$s and plural $R^{14}$s, as well. The number n represents an integer in the range of 1 to 5.

The sulfur-containing resin (K) is preferably polymer or copolymer having a sulfonate group and more preferably sulfur-containing polymer or copolymer including, as a constituent, acrylamide monomer containing sulfonate group. Examples of the acrylamide monomer containing sulfonate group include 2-acrylamidepropane sulfonic acid, 2-acrylamide-n-butane sulfonic acid, 2-acrylamide-n-hexane sulfonic acid, 2-acrylamide-n-octane sulfonic acid, 2-acrylamide-n-dodecane sulfonic acid, 2-acrylamide-n-tetradecane sulfonic acid, 2-acrylamide-2-methylpropane sulfonic acid, 2-acrylamide-2-phenylpropane sulfonic acid, 2-acrylamide-2,2,4-trimethylpentane sulfonic acid, 2-acrylamide-2-methylphenylethane sulfonic acid, 2-acrylamide-2-(4-chrolophenyl)propane sulfonic acid, 2-acrylamide-2-carboxymethylpropane sulfonic acid, 2-acrylamide-2-(2-pyridyl)propane sulfonic acid, 2-acrylamide-1-methylpropane sulfonic acid, 3-acrylamide-3-methylbutane sulfonic acid, 2-methacrylamide-n-decane sulfonic acid, 2-methacrylamide-n-tetradecane sulfonic acid and the like. Among these examples, 2-acrylamide-2-methylpropane sulfonic acid is particularly preferable.

As the copolymer component to be copolymerized with the acrylamide monomer containing sulfonate group, styrene monomer and acrylic monomer are preferable. Specifically, combination of styrene and acrylic acid ester or methacrylic acid ester is preferable.

Specific examples of the positively chargeable charge control agent for use in the present invention include: (a) copolymer obtained by polymerization using (meth)acrylic acid ester monomer as a copolymerization component; (b) copolymer obtained by polymerization using a monomer having amino group as a copolymerization component; (c) an amino compound having hydroxyl group; (d) polymer having an imidazolium salt as a structural unit; (e) a quaternary ammonium salt compound; (f) nigrosine compound; (g) triphenyl methane compound and the like.

One type of these positively chargeable charge control agents may be used solely or two or more types thereof may be used in combination.

As the copolymer (a) obtained by polymerization using (meth)acrylic acid ester monomer as a copolymerization component, copolymer including (meth)acrylic acid ester as represented by general formula (VIII) below as the main component is preferably used.

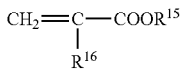

(VIII)

In general formula (VIII), $R^{15}$ represents a C4 alkyl group and $R^{16}$ represents hydrogen atom or methyl group. $R^{15}$ is preferably a C6~ alkyl group and more preferably a C8~ alkyl group. $R^{15}$ is preferably a C6-C20 alkyl group. $R^{15}$ may be either normal or branched and may have a cyclic structure.

Specific examples of the (meth)acrylic acid ester monomer include n-butyl(meth)acrylate, tert-butyl(meth)acrylate, iso-butyl(meth)acrylate, n-amyl(meth)acrylate, n-hexyl(meth) acrylate, cyclohexyl(meth)acrylate, 2-ethylhexyl(meth) acrylate, n-octyl(meth)acrylate, iso-octyl(meth)acrylate, n-nonyl(meth)acrylate, n-lauryl(meth)acrylate, n-tridecyl (meth)acrylate, n-stearyl(meth)acrylate, isobonyl(meth) acrylate, and the like. In the present invention, "(meth) acrylate" represents methacrylate or acrylate.

The type of a copolymer component to be copolymerized with the monomer of general formula (VIII) described above is not particularly restricted, and examples thereof include: (meth)acrylic acid ester monomer having a C1-C3 alkyl group; styrene monomer; olefin monomer; diene monomer; and vinyl monomer such as halogenated vinyl, vinyl ester and (meth)acrylic acid. The monomer of general formula (VIII) may be preferably copolymerized with the monomer (b) having amino group described in detail below.

As the copolymer (b) obtained by polymerization using a monomer having amino group as a copolymerization component, copolymer including a monomer having amino group represented by general formula (IX) below as the main component is preferably used.

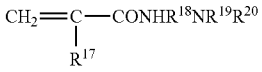

(IX)

In general formula (IX), $R^{17}$ represents hydrogen atom or methyl group, $R^{18}$ represents a C1-C7 divalent organic group, $R^{19}$ and $R^{20}$ represent hydrogen atom or a C1-C20 organic group, respectively. $R^{19}$ and $R^{20}$ are preferably a C2-C4 organic group or may have either a C4-C20 cyclic structure where $R^{19}$ and $R^{20}$ are chemically bonded to each other or a C4-C19 cyclic structure including at least one of nitrogen, oxygen and sulfur atoms where $R^{19}$ and $R^{20}$ are chemically bonded to each other. Specific examples of the monomer having amino group of general formula (IX) include N,N-dimethylaminoethyl(meth)acrylamide, N,N-diethylaminoethyl(meth)acrylamide, N,N-dimethylaminopropyl(meth)acrylamide, N,N-diethylaminopropyl(meth)acrylamide, p-N,N-dimethylaminophenyl(meth)acrylamide, p-N,N-diethylaminophenyl(meth)acrylamide, p-N,N-dipropylaminophenyl(meth)acrylamide, p-N,N-dibutylaminophenyl(meth)acrylamide, p-N-laurylaminophenyl(meth)acrylamide, p-N-stearylaminophenyl(meth)acrylamide, p-N,N-dimethylaminobenzyl (meth)acrylamide, p-N,N-diethylaminobenzyl(meth)acrylamide, p-N,N-dipropylaminobenzyl(meth)acrylamide, p-N,N-dibutylaminobenzyl(meth)acrylamide, p-N-laurylaminobenzyl(meth)acrylamide, p-N-stearylaminobenzyl (meth)acrylamide, and the like. One type of the monomer having amino group represented by general formula (IX) may be used solely or two or more types thereof may be used in combination. In the present invention, "(meth)acrylate" represents methacrylate or acrylate.

The component (a) described above is preferably copolymerized, as a copolymerization component, with the monomer of general formula (IX). Examples of other copolymerization component include: (meth)acrylic acid ester monomer having a C1-C3 alkyl group; styrene monomer; olefin monomer; diene monomer; and vinyl monomer such as halogenated vinyl, vinyl ester and (meth)acrylic acid.

As the amino compound (c) having hydroxyl group, a compound represented by general formula (X) or general formula (XI) is preferably used.

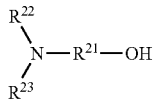

(X)

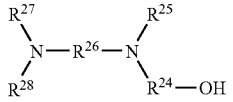

(XI)

In general formula (X), $R^{21}$, $R^{24}$ and $R^{26}$ represent a C1-C8 alkylene group or an ethylene oxide group having a repetition number in the range of 1 to 4, respectively, and $R^{22}$ to $R^{28}$ represent C1-C8 alkyl groups, respectively. $R^{22}$ and $R^{23}$ of general formula (X) may be the same or different from each other. $R^{24}$ to $R^{28}$ of general formula (XI) may be the same or different from each other.

Specific examples of the amino compound having hydroxyl group as represented by aforementioned general formula (X)

or general formula (XI) include dimethylethanolamine, which is commercially available as, for example, "KAOLISER NO. 25" (the product name, manufactured by Kao Corporation) and "POLYCAT 17" (the product name, manufactured by Sankyo Air Products Co., Ltd.).

As the polymer (d) having an imidazolium salt as a structural unit, polymer including an imidazolium salt as represented by general formula (XII) below as the main component is preferably used.

(XII)

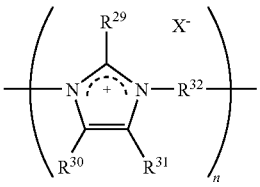

In general formula (XII), $R^{29}$ represents hydrogen or a C1-C17 hydrocarbon group, $R^{30}$ and $R^{31}$ each independently represent hydrogen or a C1-C8 hydrocarbon group. $R^{30}$ and $R^{31}$ may be bonded to each other to form a cyclic structure. $R^{32}$ represents a C1-C12 alkylene group which may include an ether bond, $X^-$ represents an anion and n represents an integer in the range of 2 to 100.

Examples of the C1-C17 hydrocarbon group in $R^{29}$ include: alkyl group such as methyl, ethyl, undecyl, tridecyl, pentadecyl, heptadecyl groups; alkenyl group such as undecenyl, tridecenyl, heptadecenyl groups; alkylphenyl group such as pentylphenyl, hexylphenyl groups; aryl group such as phenyl group; aralkyl group such as benzyl group; and the like. Among these examples, hydrogen and a C11-C17 aralkyl group are preferable and undecyl, tridecyl, pentadecyl and heptadecyl groups are particularly preferable.

Examples of the C1-C8 hydrocarbon group in $R^{30}$ and $R^{31}$ include: alkyl group such as methyl, ethyl, propyl, butyl, hexyl and octyl groups; aryl group such as phenyl group; aralkyl group such as benzyl group; and the like. Examples of a cyclic structure where $R^{30}$ and $R^{31}$ are bonded to each other include benzo group. Among these examples, hydrogen, methyl, ethyl and benzo groups are preferable and hydrogen and benzo groups are particularly preferable.

Specific examples of $R^{32}$ include methylene, ethylene, trimethylene, tetramethylene, hexamethylene, octamethylene, decamethylene, dodecamethylene, —$CH_2CH_2OCH_2CH_2$—, —$CH_2CH_2OCH_2OCH_2CH_2$—, and —$CH_2CH_2OCH_2CH_2OCH_2CH_2$—. Among these examples, ethylene, trimethylene, tetramethylene, hexamethylene, —$CH_2CH_2OCH_2CH_2$— and —$CH_2CH_2OCH_2OCH_2CH_2$— groups are preferable and trimethylene, tetramethylene, hexamethylene, and —$CH_2CH_2OCH_2CH_2$— are particularly preferable.

Examples of $X^-$ include halogen ion, sulfate ion, nitrate ion, phosphate ion, sulfonate ion (p-toluenesulfonate ion, methylsulfonate ion, hydroxynaphthosulfonate ion and the like), carboxylate ion (formate ion, acetate ion, propionate ion, benzonate ion and the like), borate ion (borate ion, methaborate ion, tetrafluoroborate ion, tetraphenylborate ion and the like), and metal oxoate ion (molybdate ion, tungustate ion and the like). Among these examples, carboxylate ion, sulfonate ion, borate ion and oxoate ion are preferable.

As the quaternary ammonium salt compound (e), a compound as represented by general formula (XIII) is preferably used.

(XIII)

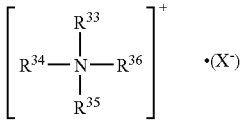

In general formula (XIII), $R^{33}$, $R^{34}$, $R^{35}$ and $R^{36}$ each independently represent alkyl group which may have a substituent, cyclic alkyl group which may have a substituent, aralkyl group which may have a substituent and aryl group which may have a substituent, and $X^-$ represents an anion. Specific examples of the alkyl group include a C1-C8 normal or branched alkyl group such as methyl, ethyl groups. Examples of the substituent of the alkyl group include: a C1-C3 alkoxy group such as methoxy, ethoxy groups; halogen; nitro group; phenyl group; and the like.

Examples of the cyclic alkyl group include a C3-C8 cycloalkyl group such as cyclopropyl, cyclopentyl, cyclohexyl and cycloheptyl groups. Examples of the substituent of the cyclic alkyl group include those exemplified above in relation to the substituent of the alkyl group.

Specific examples of the aralkyl group include benzyl, α,α-dimethylbenzyl, tolyl, phenetyl groups and the like, and examples of the substituent thereof include those exemplified above in relation to the substituent of the alkyl group.

Specific examples of the aryl group include phenyl, naphthyl groups and the like, and examples of the substituent thereof include those exemplified above in relation to the substituent of the alkyl group.

The anion $X^-$ is exemplified by an organic or inorganic anion, and specific examples thereof include naphtholsulfonate anion, toluenesulfonate anion, halogen anion and the like.

As the nigrosine compound (f), compounds known as nigrosine dyes can be used and commercially available examples thereof include "Nigrosine Base EX", "Oil Black BS", "Oil Black SO", "BONTRON N-01", "BONTRON N-07", "BONTRON N-09", "BONTRON N-11" (these are manufactured by Orient Chemical Industries Co., Ltd.)

As the triphenyl methane compound (g), a compound represented by general formula (XIV) below, for example, is preferably used.

(XIV)

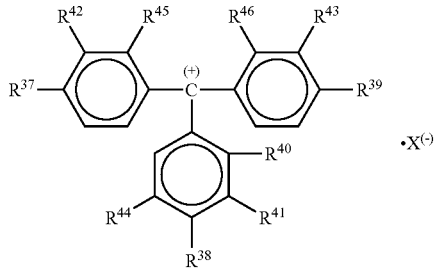

In general formula (XIV), $R^{37}$ and $R^{39}$ represent groups each independently selected from amino group, mono/dialkylamino group having a C1-C4 alkyl group, mono/di-ω-hydroxyalkylamino group having a C2-C4 alkyl group, and phenyl amino group which is unsubstituted or substituted with N-alkyl group; $R^{38}$ represents hydrogen or a group selected from those explained in relation to $R^{37}$ and $R^{39}$; $R^{40}$ and $R^{41}$ each independently represent hydrogen, halogen or sulfonate group, or $R^{40}$ and $R^{41}$ are condensed to form a phenyl ring; $R^{42}$, $R^{43}$, $R^{45}$ and $R^{46}$ each independently represent hydrogen or methyl or ethyl group; $R^{44}$ represents hydrogen or halogen; $X^-$ represents halogen ion, sulfate, molybdate, phosphomolybdate or boron anion.

Among these examples, it is preferable that $R^{37}$ and $R^{39}$ are phenylamino groups, $R^{38}$ is m-methylphenylamino group and $R^{40}$ to $R^{46}$ are hydrogen atoms.

In the present invention, the negatively chargeable charge control agent or the positively chargeable charge control agent described above is preferably added to the polyurethane foam body such that a toner transfer rate (M/A) of at least 0.25 mg/cm$^2$ is achieved. By achieving such a toner transfer rate (M/A) as described above, inconveniences like scratchiness in images can be prevented from occurring.

The toner transfer roller of the present invention has a structure where a polyurethane foam body layer, produced by blending with stirring a mixture of raw ingredients including polyol, polyisocianate, foaming agent, catalyst and the like to effect foaming, is provided around the outer periphery of the rotating shaft of the roller. The toner transfer roller of the present invention can be easily obtained by including the negatively chargeable charge control agent or the positively chargeable charge control agent in the mixture of raw ingredients and effecting foaming according to the conventional method. Since most of the aforementioned examples of the negatively chargeable charge control agent or the positively chargeable charge control agent are soluble to water or an organic solvent and do not inhibit foaming, a polyurethane foam body layer can be easily formed. Even in a case where the negatively chargeable charge control agent or the positively chargeable charge control agent are not soluble to a solvent, a polyurethane foam body layer can be formed as in the case where the charge control agent is soluble to a solvent by dispersing the charge control agent in a dispersing medium.

Alternatively, the polyurethane foam body roller, formed in advance, may be impregnated with a solution or a dispersion of the negatively chargeable charge control agent or the positively chargeable charge control agent, so that the negatively chargeable charge control agent or the positively chargeable charge control agent is attached to the polyurethane foam body roller.

Regarding the method of producing the polyurethane foam body roller, the conventionally known methods of various types can be used.

Specifically, a known method includes: preparing materials for formation of a foam body, including polyol component, polyisocyanate component, a physical foaming agent such inert gas, water and an organic compound having a relatively low boiling point, and optionally a catalyst for urethane reaction, and the like; pouring the materials thus prepared into a mold of a predetermined shape in which a rotating shaft has been set; and effecting foaming and curing. Alternatively, another known method includes: preparing the aforementioned materials for formation of a foam body; effecting free foaming of the materials in a block-like shape and thermally setting the foamed materials; cutting a piece of resin of a predetermined dimension out from the block by machining; and mounting a rotating shaft thereto. In the foaming process, foaming may be effected by mechanical stirring instead of using.

Among the methods described above, the method using a cylindrical mold as a mold is preferable because no polishing is required for the product after removal thereof from the mold and no undesirable roughness is generated at the outer peripheral surface of the polyurethane foam body layer. Further, in a case where a machining process and/or a polishing process is required, it is advantageous to employ the hot wire cutting method in which, for example, an electrically heated nichrome wire is brought into contact with the foam body roller, while the foam body roller is rotated about the rotating shaft, in order to suppress generation of roughness at the surface of the foam body roller.

Regarding the material for formation of the foam body for use in the present invention, the polyol component and the polyisocyanate components may be contained in prepolymer form obtained by reacting these components with each other.

The type of polyol or the polyol component for use in production of prepolymer is not particularly restricted and examples thereof include polyether polyol, polyester polyol, hydrophobic polyol and the like. Preferable examples of polyether polyol for use include polyol obtained by addition-polymerization of ethylene oxide or proplylene oxide with glycerine, polytetramethylene glycol, ethylene glycol, propanediol, butanediol and the like. Preferable examples of polyester polyol for use include condensation-based polyester polyol obtained by condensation of diol or triol with dicarboxylic acid, lactone-based polyester polyol obtained by ring-opening polymerization of lactone with diol or triol as the base materials, ester-modified polyol which has been subjected to ester modification at the terminal end of polyether polyol with lactone. Further, examples of hydrophobic polyol for use include polyisoprene polyol, polybutadiene polyol, hydrogenated polybutadiene polyol and the like. One type of these polyol components may be solely used or two or more types thereof may be used in combination.

Examples of polyisocyanate or the polyisocyanate component for use in production of prepolymer include: tolylene diisocyanate (TDI), diphenylmethane diisocyanate (MDI), crude diphenylmethane diisocyanate (crude MDI), isophorone diisocyanate, hydrogenated diphenylmethane diisocyanate; hydrogenated tolylene diisocyanate; polyisocyanate not having an unsaturated bond, such as hexamethylene diisocyanate; products obtained by modification of the examples above with isocyanurate, carbodiimide, glycol or the like. One type of these polyisocyanate components may be solely used or two or more types thereof may be used in combination.

Further, as the foaming agent, a physical foaming agent such as water, inert gas and an inactive organic compound having a relatively low boiling point is used. Examples of the inactive organic compound having a relatively low boiling point include, n-pentane, isopentane, cyclopentane, methylene chloride, fron 134a (1,1,1,2-tetrafluoroethane), fron 245fa (1,1,1,3,3-pentafluoropropane), fron 365mfc (1,1,1,3,3-pentafluorobutane), fron 356, fron 141b (1,1-dichloro-1-fluoroethane), fron 142b (1-chloro-1,1-difluoroethane), fron 22 (chlorodifluoromethane). One type of these physical foaming agents may be solely used or two or more types thereof may be used in combination.

In the toner transfer roller of the present invention, a conductivity enhancing agent such as carbon which is normally used for a toner transfer roller is not blended.

Yet further, examples of the catalyst which may be contained in the materials for formation of the foam body according to necessity include: organic metal catalyst such as dibutyltin dilaurate, dibutyltin diacetate, stannous octoate, dibutyltin mercaptide, dibutyltin thiocarboxylate, dibutyltin dimaleate, dioctyltin mercaptide, dioctyltin thiocarboxylate, phenylmercury, silver propionate, and tin octenate; amine catalyst such as triethylamine, N,N,N',N'-tetramethylethylenediamine, triethylenediamine, N-methylmorpholine, dimethylaminoethanol, bis(2-dimethylaminoethyl)ether, 1,8-diazabicyclo(5,4,0)-undecene-7, and the like. One type of these examples of the catalyst may be solely used or two or more types thereof may be used in combination.

Yet further, a foaming adjusting agent may be used according to necessity in the materials for formation of the foam body and examples thereof include polyether silicone oil, nonionic surfactant, ionic surfactant and the like. One type of these examples of the foaming adjusting agent may be solely used or two or more types thereof may be used in combination.

Regarding a chemical foaming agent in the materials for formation of the foam body, there is no particular restriction thereon and any suitable one can be selected for use from the known inorganic foaming agents and organic foaming agents. Examples of the inorganic foaming agent include sodium hydrogen carbonate, ammonium hydrogen carbonate, sodium borohydride and the like. Examples of the organic foaming agent include azodicarbonamide, azobisisobutyronitrile, barium azodicarboxylate, dinitrosopentamethylenetetramine, p,p'-oxybis(benzenesulfonylhydrazide), p-toluenesulfonyl hydrazide and the like. One type of these examples of the chemical foaming agent may be solely used or two or more types thereof may be used in combination. Among these examples, p,p'-oxybis(benzenesulfonylhydrazide) and azodicarbonamide are particularly preferable because densely and evenly foamed cells are obtained. Use of the chemical foaming agent is generally 0.5 to 15 parts by mass and preferably 1 to 12 parts by mass with respect to 100 parts by mass of a rubber elastic body.

In preparation of the materials for formation of the foam body of the present invention, it is preferable that the additives other than the rubber elastic body and the chemical foaming agent of the materials are blended at the temperature of 110 to 180° C. and then the chemical foaming agent is blended thereto at the relatively low temperature in the range of 50 to 90° C. to suppress premature foaming. Blending is generally carried out by using rolls, a kneader, a mixer and the like.

Next, the materials for formation of the foam body thus prepared is extrusion-molded to have a tube-like shape by an extruder. The temperature at which the extrusion-molding is carried out is advantageously set at the temperature lower than the foaming temperature, e.g. 40 to 60° C., to suppress premature foaming.

Next, the tube-like molded body is cut to predetermined dimensions by a cutter or the like and then a dummy shaft is inserted therethrough to produce a preliminary molded body. The preliminary molded body thus produced is set inside the mold and subjected to heating and pressurizing processes. The preliminary molded body thus treated is then removed from the mold and foaming is effected. The dummy shaft is removed and a rotating shaft with adhesive is inserted through the foamed body and attached to the foamed body by heating. Thereafter, the foamed body is machined to have a predetermined roller diameter by using the hot wire cutting method or the like described above in order to suppress generation of undesirable roughness at the outer peripheral surface of the polyurethane foam body layer, whereby the targeted polyurethane foam body roller is obtained.

Examples of the material used for the rotating shaft for use with the polyurethane foam body roller include: plastics such as ABS, POM, polycarbonate and nylon; a metal member obtained by plating a steel material such as sulfur free cutting steel with zinc or the like; a metal material such as aluminum, stainless steel, magnesium alloy and the like.

The toner transfer roller of the present invention is preferably used for an image forming device such as an electrophotographic device and an electrostatic recording device like a photocopier, a laser printer and a facsimile. By using the toner transfer roller of the present invention as a toner supply roller, in particular, there can be provided an image forming device which hardly generates scratchiness in images.

EXAMPLES

Next, the present invention will be described further in details by Examples. It should be noted that the present invention is not restricted by these Examples.

(Evaluation Method)

(1) Evaluation According to the Toner Transfer Rate (M/A)

Evaluation was made according to the toner transfer rate (M/A) achieved by the toner transfer roller of each of Examples and Comparative Examples. The toner transfer rate (M/A) was measured according to the method described below (refer to FIG. 1).

Toner on the developing roller 2 after passing the blade 4 was sucked by using a suction pump having a cylindrical filtering paper (ADVANTEC 86R) attached thereto such that toner present in approximately 14.4 $cm^2$ of the roller surface was sucked. The toner collected on the filtering paper was weighed and the amount of toner per unit area ($mg/cm^2$) was measured (see Table 1 regarding the type of the toner).

(2) Evaluation of Quality and Sustainability of Image

The toner transfer roller of each of Examples and Comparative Examples was installed to an image forming device and printing (1000 sheets) was carried out in the usual manner. Thereafter, 3 sheets were printed out such that each sheet carried a full-size solid printing image of the color of the toner contained in the image founing device. Presence/absence of scratchiness of the image was visually observed for the second printing of the three sheets and the quality of the image was evaluated (see Table 1 regarding the type of the toner).

Further, for Example 1 and Comparative Example 2, printing was carried out in the usual manner from the $1^{st}$ sheet (expressed as "0 K" in Table 2) to the $10000^{th}$ sheet (expressed as "10 K" in Table 2) and 3 sheets each having a full-size solid printing image of the color of the toner contained in the image forming device were printed out for every 1000 sheets. Presence/absence of scratchiness of the image was visually observed for the second printing of the three sheets and the sustainability of the image was evaluated. The evaluation criteria are as follows.

5 points: no scratchiness was observed, 4 points: minor scratchiness was observed, 3 points: scratchiness was observed in an area corresponding to ¼ of the solid printing image, 2 points: scratchiness was observed in an area corresponding to ⅓ of the solid printing image, 1 points: scratchiness was observed in an area corresponding to ½ of the solid printing image.

(3) Production Cost

Production cost was relatively evaluated for the toner transfer roller of each of Examples and Comparative Examples.

Example 1

Materials for formation of a polyurethane foam body was prepared by blending 70 parts by mass of polyether polyol (average molecular weight: 5000, the number of functional groups: 3), 30 parts by mass of polymer polyol of styrene graft type, 0.3 parts by mass of triethylenediamine, 0.2 parts by mass of N-methylmorpholine, 1.5 parts by mass of water, 1.5 parts by mass of a silicone foaming adjusting agent, an amount corresponding to index 105 of isocyanate of TDI/MDI mixed type, and 1 parts by mass of the boric acid ester compound represented by general formula (I) ($R^1$ and $R^2$ are phenyl groups and M is potassium) as a negatively chargeable charge control agent.

By using these materials for formation of a polyurethane foam body, free foaming was effected. The foamed body thus obtained was cut to 16×16×230 mm, a hole for insertion of a shaft was formed, and a shaft having adhesive coated thereon was inserted through the hole. The product was then heated at 90° C. for 120 minutes so that the shaft was attached to the foamed body. Thereafter, the foamed body was polished by a polishing machine, whereby a toner transfer roller having outer diameter of 14 mm and length of 220 mm was obtained.

Figure 2:
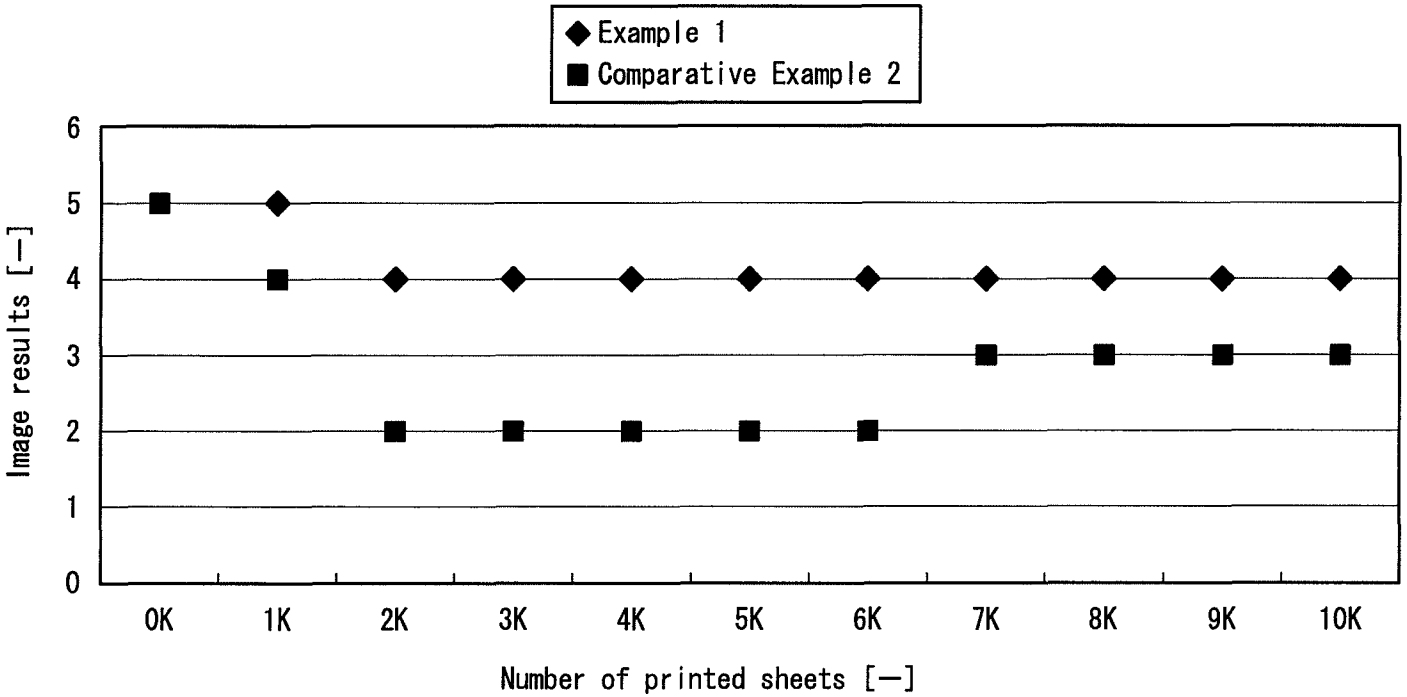
FIG. 2 is a graph showing an evaluation results of sustainability of image quality.

The toner transfer roller thus obtained was evaluated by the methods described above and the results thereof are shown in Table 1, Table 2 and FIG. 2.

Example 2

A toner transfer roller was obtained in the same manner as Example 1, except that 1 part by mass of acrylic acid ester monomer copolymer as a positively chargeable charge control agent was blended in place of the boric acid ester compound as the negatively chargeable charge control agent. The toner transfer roller thus obtained was evaluated by the methods described above and the results thereof are shown in Table 1.

Comparative Example 1

An urethane polymer containing 7.5 mass % of NCO was obtained by reacting 100 g of polyether-based polyol (produced by adding propylene oxide and ethylene oxide to glycerine such that the content of polyoxyethylene chain was eventually 20 mass % and the molecular weight of the polymer was 5000) with 25 g of tolylenediisocyanate (the content of 2,6 isomer: 20%, "TD 180" manufactured by NIPPON POLYURETHANE INDUSTRIES, Co., Ltd.). To 100 g of the urethane prepolymer thus obtained, there were added 25 g of water dispersion of conductive carbon containing 8 mass % of conductive carbon black ("W-311N", manufactured by LION CORPORATION), 1 g of N-methylmolpholine and 0.3 g of triethylamine as catalysts for activating the reaction, and 1.5 g of silicone-based surfactant ("L-520", manufactured by Nippon Unicar Company Limited). The mixture was mixed by stirring for 8 seconds and then immediately poured into a mold having the inner volume of 900 $cm^3$. The amount of water added to the isocyanate group of the urethane polymer was 12 times as much as the isocyanate group on chemical equivalence. The volume of a foamed body obtained as a result of free foaming of the materials of the same blending and contents as described above in the ambient environment was 1125 $cm^3$. After the time required for the foaming solution to be cured (approximately 10 minutes), the foamed body was taken out by depressurization. The foamed body thus collected was provided with a rotating shaft and polished in the same manner as Example 1, whereby a toner transfer roller of the same dimension as the toner transfer roller of Example 1 was obtained. The toner transfer roller thus obtained was evaluated by the methods described above and the results thereof are shown in Table 1.

Comparative Example 2

A toner transfer roller was obtained in the same manner as Comparative Example 1, except that 25 g of water was blended in place of water dispersion of conductive carbon containing 8 mass % of conductive carbon black ("W-311N", manufactured by LION CORPORATION), whereby a toner transfer roller was obtained. The toner transfer roller thus obtained was evaluated by the methods described above and the results thereof are shown in Table 1, Table 2 and FIG. 2.

Comparative Example 3

A rectangular piece having dimension of longitudinal length: 300 to 400 mm, lateral length: 350 to 500 mm and height: 25 mm was cut out from soft slab foam. The foam thus cut out was impregnated with an electrically conductive processing solution, obtained by mixing a water dispersion containing 36 mass % of carbon black in a dispersed form and an acrylic emulsion (the product name "Nipol LX852" manufactured by Zeon Corporation) by 1:1, for 5 minutes at 20° C. The foam, of which cells had been impregnated with water, carbon black and acrylic resin, was then passed through between a pair of rolls set to have a clearance of 0.2 mm therebetween, so that moisture and the like were removed therefrom. Next, the foam was heated and dried in a heated oven set at 100° C. for 60 minutes, so that moisture was substantially eliminated therefrom, the acrylic resin was crosslinked, and carbon black was fixed to the cell walls and the skeleton of the foam by the acrylic resin thus crosslinked and cured. The acrylic resin was further crosslinked thereafter, whereby carbon black was further firmly fixed on the cell walls and the like.

The foam body thus obtained was provided with a rotating shaft and then polished in the same manner as in Example 1, whereby a toner transfer roller of the same dimension as that of Example 1 was obtained. The toner transfer roller thus obtained was evaluated by the methods described above and the results thereof are shown in Table 1.

Comparative Example 4

The toner transfer roller which was the same as that of Comparative Example 1 was evaluated by the methods described above (the positively chargeable charge control agent was used). The results are shown in Table 1.

TABLE 1

| | | Example 1 | Comparative Example 1 | Comparative Example 2 | Comparative Example 3 | Example 2 | Comparative Example 4 |
|---|---|---|---|---|---|---|---|
| Toner to be used | | Negatively chargeable charge control agent | | | | Positively chargeable charge control agent | |
| Charge | Type | Boric acid | — | — | — | Acrylic acid | — |

TABLE 1-continued

| | Example 1 | Comparative Example 1 | Comparative Example 2 | Comparative Example 3 | Example 2 | Comparative Example 4 |
|---|---|---|---|---|---|---|
| control agent | ester compound | | | | ester monomer copolymer | |
| Content (parts by mass) | 1 | — | — | — | 1 | — |
| M/A (1 to 9000 sheets) | 0.28-0.45 | 0.21-0.33 | 0.19-0.31 | 0.28-0.44 | 0.30-0.45 | 0.15-0.20 |
| Image quality (presence/absence of scratchiness) | Absent | Present | Present | Absent | Absent | Present |
| Production cost (relative evaluation) | Low | High | Low | High | Low | High |

TABLE 2

| | Number of printed sheets | | | | | | | | | | |
|---|---|---|---|---|---|---|---|---|---|---|---|
| | 0K | 1K | 2K | 3K | 4K | 5K | 6K | 7K | 8K | 9K | 10K |
| Example 1 | 5 | 5 | 4 | 4 | 4 | 4 | 4 | 4 | 4 | 4 | 4 |
| Comparative Example 2 | 5 | 4 | 2 | 2 | 2 | 2 | 2 | 3 | 3 | 3 | 3 |

INDUSTRIAL APPLICABILITY

The toner transfer roller of the present invention exhibits a relatively low toner charge (Q/M) and a relatively high toner transfer rate (M/A). Accordingly, inconveniences such as scratchiness in an image is prevented by using the toner transfer roller of the present invention as a toner supply roller for an image forming device such as an electrophotographic device and an electrostatic recording device like a photocopier, a laser printer and a facsimile.

The charge controlling agent as described above can be used for other rollers than a toner supply roller, although explanation is made in relation to a toner supply roller in the foregoing Examples.

The invention claimed is:

1. A combination of a toner transfer roller and a toner having a physical property of being only negatively chargeable, the toner transfer roller comprising a rotating shaft and a polyurethane foam body layer provided to surround the rotating shaft, wherein the polyurethane foam body layer contains a charge control agent having a physical property of being only negatively chargeable with respect to polyurethane in triboelectric series, and the negatively chargeable charge control agent is selected from the group consisting of: (A) borate ester compound; (B) polyhydroxy alkanoate; (D) a metal compound of oxynaphthoic acid derivative; (F) a metal compound of aromatic oxycarboxylic acid; (I) an organic metal compound in which zirconium or aluminum or zinc is coordinated by and/or bonded with an aromatic compound selected from the group consisting of aromatic diol, aromatic hydroxycarboxylic acid, aromatic monocarboxylic acid and aromatic polycarboxylic acid; and (J) a complex of boron or aluminum and a benzilic acid derivative, and the physical property of the charge control agent is determined by a method including: leaving the charge control agent under an atmosphere at 23° C. and relative humidity of 55% for 4 hours; then removing static electricity from the charge control agent by using an antistatic device; rubbing a polyurethane foam body and the charge control agent against each other and measuring static electricity thereof by using a static electricity sensor; and confirming that the charge control agent has been only negatively charged with respect to the polyurethane foam body in triboelectric series;

wherein the polyurethane foam body layer has the toner thereon, wherein the toner is negatively charged.

2. An image forming device, characterized in that it is provided with the combination of the toner transfer roller and the toner of claim 1.

3. The combination of the toner transfer roller and the toner according to claim 1, wherein the borate ester compound (A) is a compound represented by general formula (I) below:

(I)

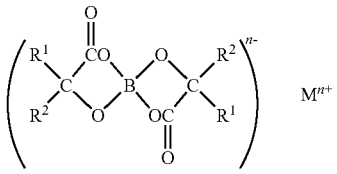

wherein $R^1$ and $R^2$ each represent a hydrogen atom, alkyl group or aryl group; $R^1$ and $R^2$ may be of the same atom or group; M represents an alkali metal or alkaline earth metal; n represents an integer; the alkyl group is selected from the group consisting of methyl, ethyl, propyl, butyl and pentyl, the aryl group is selected from the group consisting of phenyl, tolyl, xylyl, biphenyl, naphthyl, anthryl and phenanthryl; and the alkaline metal or alkaline earth metal represented by M is selected from the group consisting of lithium, potassium, calcium and sodium.

4. The combination of the toner transfer roller and the toner according to claim 1, wherein the polyhydroxy alkanoate (B) is a substance represented by general formula (II) below:

(II)

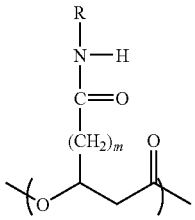

wherein R represents $-A^1-(SO_2R^3)x$; $R^3$ represents OH, a halogen atom, $ON_a$, OK, or $OR^{3a}$; $R^{3a}$ and $A^1$ each represents a substituted or unsubstituted aliphatic hydrocarbon group, a substituted or unsubstituted aromatic group or a substituted or unsubstituted heterocyclic group; m and x each represent an integer selected from 1 to 8.

5. The combination of the toner transfer roller and the toner according to claim 1, wherein the metal compound of oxynaphthoic acid derivative (D) comprises an organic metal compound constituted of an oxynaphthoic acid derivative represented by general formula (III) below:

(III)

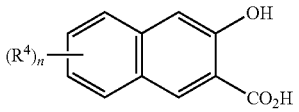

wherein $R^4$ represents hydrogen or a normal or branched alkyl, alkoxy, nitro, amino, carboxyl, aralkyl, phenyl, benzyl group or a halogen atom; n represents an integer in the range of 0 to 4; and a metal element of the metal compound is selected from the group consisting of aluminum, chromium, cobalt, iron, titanium and zinc.

6. The combination of the toner transfer roller and the toner according to claim 1, wherein the aromatic oxycarboxylic acid of the metal compound of aromatic oxycarboxylic acid (F) is selected from the group consisting of salicylic acid, m-oxybenzoic acid, p-oxycarboxylic acid, gallic acid, mandelic acid and tropic acid.

7. The combination of the toner transfer roller and the toner according to claim 1, wherein the aromatic oxycarboxylic acid of the metal compound of aromatic oxycarboxylic acid (F) is selected from the group consisting of isophthalic acid, terephthalic acid, trimellitic acid and naphthalene dicarboxylic acid.

8. The combination of the toner transfer roller and the toner according to claim 6, wherein a metal species of the metal compound of aromatic oxycarboxylic acid (F) is a polyvalent metal and is selected from the group consisting of magnesium, calcium, strontium, lead, iron, cobalt, nickel, zinc, copper, zirconium, hafnium, aluminum and chromium.

9. The combination of the toner transfer roller and the toner according to claim 1, wherein the complex (J) of boron or aluminum and a benzilic acid derivative is a compound represented by general formula (VII) below:

(VII)

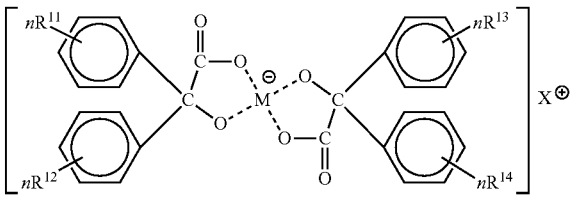

wherein M represents boron or aluminum; X represents lithium, sodium or potassium; $R^{11}$, $R^{12}$, $R^{13}$ and $R^{14}$ each represent a hydrogen atom, a C1-C4 alkyl group, a C1-C4 alkoxy group or a halogen atom; $R^{11}$, $R^{12}$, $R^{13}$ and $R^{14}$ may each exist in plural form and such plural $R^{11}$s, $R^{12}$s, $R^{13}$s and $R^{14}$s may be constituted of either the same group or different groups; and n represents an integer in the range of 1 to 5.

10. The combination of the toner transfer roller and the toner of claim 1, wherein the polyurethane foam body layer contains no conductivity enhancing agent for lowering electrical resistivity of the polyurethane foam body layer and the degree of toner charge (Q/M) to increase a rate of toner transfer (M/A), wherein the conductivity enhancing agent can be conductive carbon.

11. The combination of the toner transfer roller and the toner of claim 10, wherein the toner transfer roller, negatively charged as a result of frictional contact between toner having a physical property of being only negatively chargeable, a developing roller and itself, is capable of repelling the negatively charged toner.

12. The combination of the toner transfer roller and the toner of claim 1, wherein the charge control agent contained in the polyurethane foam body layer of the toner transfer roller is more negatively chargeable in triboelectric series than a charge control agent that is contained in the toner having a physical property of being only negatively chargeable.

13. The combination of the toner transfer roller and the toner according to claim 3, wherein the charge control agent is the borate ester compound (A).

14. The combination of the toner transfer roller and the toner according to claim 4, wherein the charge control agent is the polyhydroxy alkanoate (B).

15. The combination of the toner transfer roller and the toner according to claim 5, wherein the charge control agent is the metal compound of oxynaphthoic acid derivative (D).

16. The combination of the toner transfer roller and the toner according to claim 1, wherein the charge control agent is the metal compound of aromatic oxycarboxylic acid (F).

17. The combination of the toner transfer roller and the toner according to claim 9, wherein the charge control agent is the complex (J) of boron or aluminum and a benzilic acid derivative.

18. The combination of the toner transfer roller and the toner according to claim 1, wherein the charge control agent is present in the polyurethane foam body layer of the toner transfer roller in an amount of 0.1 to 1 parts by mass with respect to 100 parts by mass of the polyurethane foam body.

19. A method of using the combination of the toner transfer roller and the toner of claim 1, comprising transferring the toner with the toner transfer roller, wherein the toner transfer roller is used exclusively in combination with a toner having a physical property of being only negatively chargeable.

* * * * *